US005476420A

United States Patent [19]

Manning

[11] Patent Number: 5,476,420

[45] Date of Patent: Dec. 19, 1995

[54] ALL IN ONE MAILER STRUCTURE

[76] Inventor: Bruce M. Manning, 8150 S.W. 88th Ct., Miami, Fla. 33173-4149

[21] Appl. No.: 85,421

[22] Filed: Jun. 30, 1993

[51] Int. Cl.[6] ..... B42D 15/00

[52] U.S. Cl. ..... 462/6; 462/64; 462/65; 283/116

[58] Field of Search ..... 281/2, 5; 462/6, 462/7, 8, 64, 65; 283/116

[56] References Cited

U.S. PATENT DOCUMENTS

| | | | |
|---|---|---|---|
| 863,688 | 8/1907 | Albree | 283/116 |
| 914,460 | 3/1909 | Selden | 283/116 X |
| 4,860,946 | 8/1989 | Brand | 462/6 X |

*Primary Examiner*—Willmon Fridie
*Attorney, Agent, or Firm*—Malloy & Malloy

[57] ABSTRACT

A mailer structure designed to accommodate sending, through postal services, a first class letter and through components associated with the subject mailer structure, the return of a domestic return receipt in accordance with postal requirements for certified letters, return receipt requested. The subject mailer structure includes a base sheet having a first and second portions removably connected to one another by a seam preferably defined by a perforated construction to allow separation of the first and second portions. The second portion is dimensionally larger than the first portion and includes a front surface and rear surface having zones formed thereon for the individual printing or writing of a personalized message, the identification of the article being sent, and space for the address of the addressee. The rear surface may include a pre-printed standardized or generalized message thereon. The second portion separable from the first portion includes on opposite surfaces the components associated with the domestic return receipt and the return address to which the return receipt is to be sent. In an alternative embodiment, the mail structure is composed of two sheets so that a "Receipt for Certified Mail" is made simultaneously with the base sheet when typed up. The mail structure will preferably be fan folded and have drive pin holes along opposite side edges for a pin drive equipped word processor.

16 Claims, 4 Drawing Sheets

ALL IN ONE MAILER STRUCTURE

BACKGROUND OF THE INVENTION

1. Field of the Invention

This invention relates to a mailer structure which removably combines two portions, a first of which is defined by a postal return receipt indicating the delivery of certified or registered mail and wherein the second portion comprises the components and spacings for a first class letter.

2. Description of the Related Art

It is well known that numerous businesses are required from time to time to send a first class letter to an addressee. Ordinarily, the message required or desired to be sent includes two message portions. These two message portions may easily include a) a first portion defined by a generalized message and b) a second message portion which carries a more specific message targeted to the addressee of the first class letter. Such first class letters are often required to be either certified mail or registered mail with a return receipt being requested. One example might be when a person's car has been towed and the towing company is required to send a generalized message according to law to the person whose car has been towed and a more personalized message identifying the vehicle and the lienholder of the vehicle as well as certain other personalized information. Another example might be a doctor's office whose patient has missed an appointment or might, for one reason or another, claim that he did not receive a notice that he should visit his doctor. Often times, malpractice suits result from a lack of a return receipt of a notice sent by a doctor. Another example might be attorneys who inform a client of an approaching deadline when the need for an appointment prior to such deadline is a necessity.

In any case, the sending of a first class letter and the filling out of a domestic return receipt is a time-consuming and burdensome, mundane activity in many offices. This process frequently includes the steps of printing by a typewriter or a word processing device, a letter to a client, addressing an envelope to the client, addressing a domestic return receipt to a client, and a post office receipt form showing that the letter was indeed sent calling for a receipt from the post office. In addition, the above process may include the step of attaching labels to each of the foregoing, the insertion of a letter in an envelope with a correct article number assigned by the post office, attaching a conventional green card shown as post office form 3811 comprising a domestic return receipt to the envelope, attaching a receipt for certified mail, known as a post office form 3800 to the envelope. In addition, further steps include the attaching of a receipt received from the post office upon mailing of the first class letter to the office copy of the letter maintained in the file and attaching a copy of the certified number form 3811 to the 3800 form to check to see if one corresponds with the other. Efforts to resolve the problems of this procedure are found for example in U.S. Pat. No. 4,682,793.

Based on the above, there is clearly a need for an improvement in such process and the utilization of a more efficient structure. Such a preferred invention could include a combination for sending a first class letter which reduces the foregoing steps to three in number. These three steps could include inserting a certified combination comprising a mailer in a printer, entering the name of the addressee and the personalized message which may be in the form of a program of a computer and postage being attached to the structure or combination and applying the correct postage and delivering to the post office the combination to obtain the receipt.

SUMMARY OF THE INVENTION

To overcome the problems, as set forth above, a preferred invention, as disclosed herein, includes a base sheet having a first portion and a second portion each of which are removably attachable to one another by the existence of a separating seam. The separating seam has a perforated construction in the preferred embodiment so as to more specifically define a tear strip allowing the detachment of the first and second portions from one another when needed or desired. Each of the first and second portions includes a front surface and a rear surface.

The front surface of the first portion further includes a postal service return receipt zone formed thereon wherein the rear surface of the first portion includes a pre-printed return address indicia and a postal zone formed thereon. The first portion can therefore be separated from the second portion, to be described in greater detail hereinafter, and serve as the specific return receipt when such return receipts are in fact requested as in a certified letter.

The second portion has on its front surface a postal zone for the placement of the correct amount of postage thereon, an address zone for the printing or typing of the address of the addressee. The address zone and the postal zone are spaced from one another on the front surface of the second portion to leave room for a personalized message zone, therebetween preferably. The personalized message space is ample and is preferably highlighted to emphasize that in such space a personalized message can be printed thereon. Also contained on the front surface of the second portion is an article number box zone which may correspond to a portion of the postal return receipt requested indicia formed on the front portion of the first zone so that the articles can in fact be identified with one another through the provision of a plurality of numerals in such article number box which is common practice with the United States Postal Service.

The rear surface of the second portion includes a space for a pre-printed generalized message which more specifically represents a standardized message sent to all of a certain class of addressees. This of course contrasts to the personalized message space or zone on the front surface of the second portion wherein such personalized messages, i.e., tailor made for the recipient and different for each recipient. In other words, the personalized message zone will carry a message depending upon the specific circumstances of the addressee to which the first class letter defined on the second portion is in fact sent.

By virtue of this combined structure, all of the inconvenient and inefficient steps, normally associated with sending a certified letter, return receipt requested, is hereby eliminated. More specifically, the combination as set forth more specifically hereinafter, includes the separable return receipt required by the postal zone which is already pre-printed with a return address on the opposite side thereof. The second portion, as defined above and more particularly hereinafter, includes ample spaces for personalized messages while at the same time provides ample zones or spaces for postage, addressee of the person to whom the first class letter is sent, and the added convenience of a pre-printed generalized message for all such addressees.

In an alternative embodiment, the mail structure may include a second sheet for making a copy simultaneously when typed up and include holes along the opposite side edges in a removable strip for registry with a pin drive equipped word processor and the mail structure will be fan folded, see FIG. 3.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
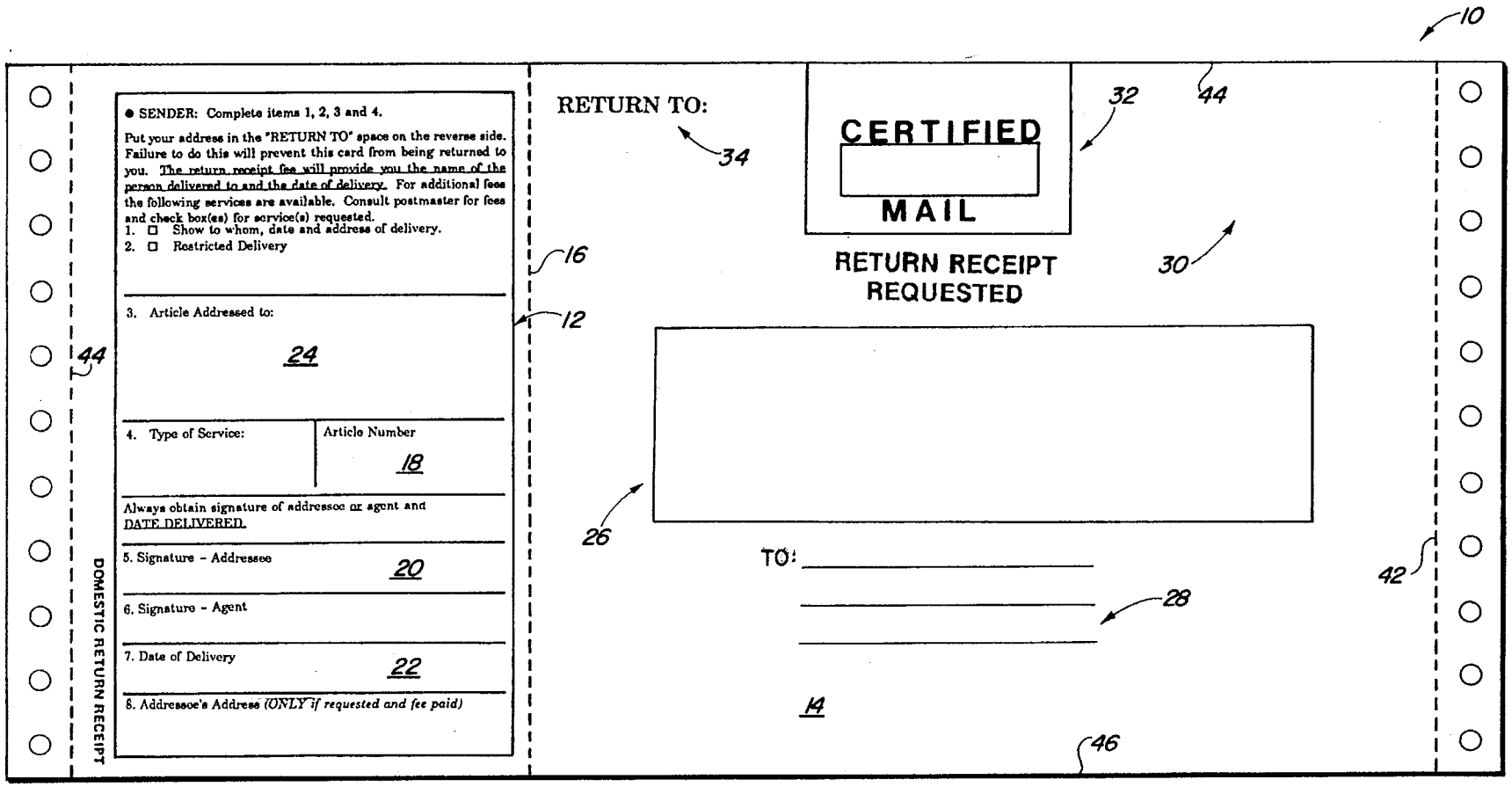
FIG. 1 is a front surface of the mailer structure of the present invention.
Figure 2:
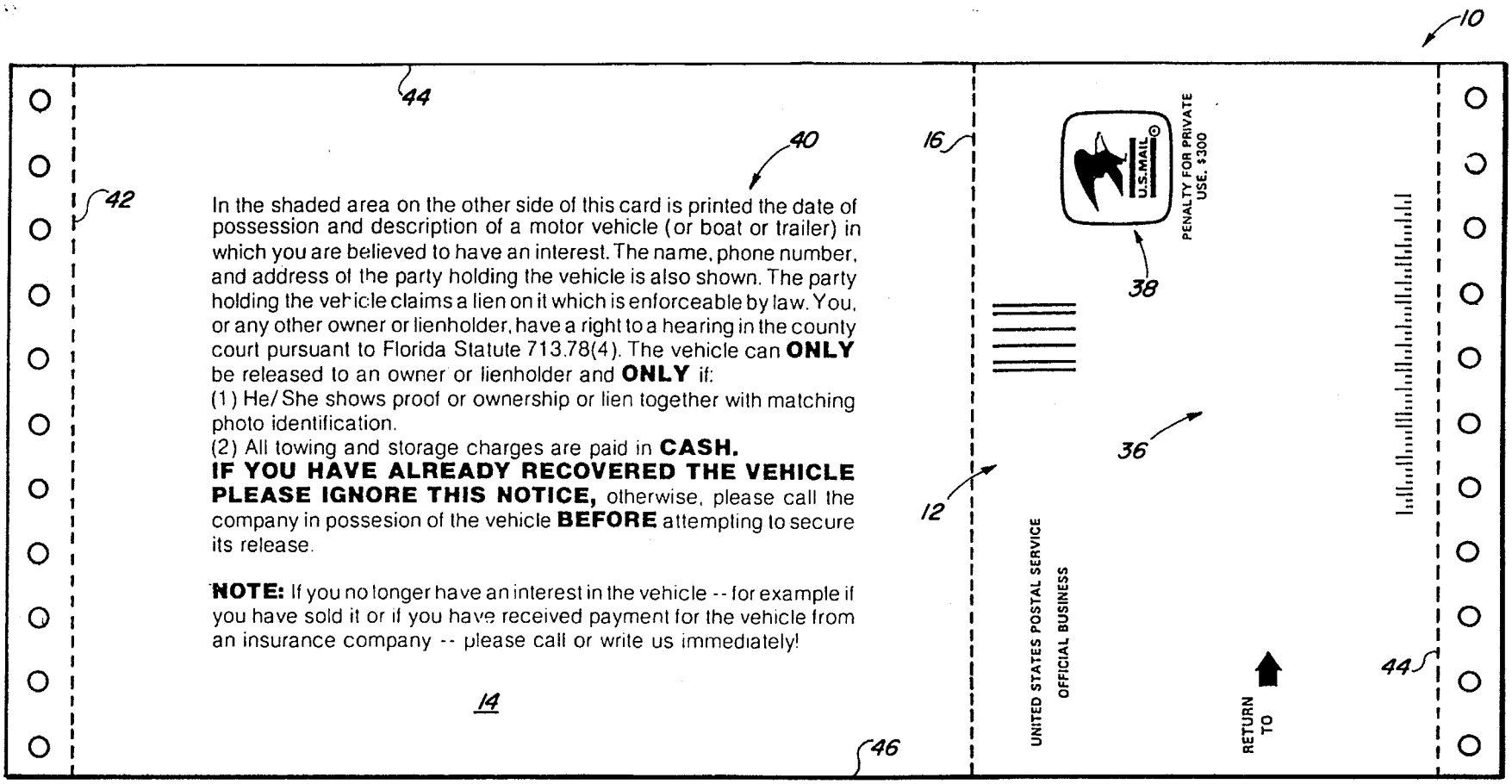
FIG. 2 is a rear surface of the mailer structure of the present invention.

As shown in FIGS. 1 and 2, the invention comprises a base sheet 10 including a first portion generally indicated as 12 and a second portion generally indicated as 14. These two portions are separated by a separating seam generally indicated as 16. The seam serves to removably interconnect the first portion 12 from the second portion 14 and is more specifically defined by a perforated construction, although other types of separating seams may be utilized. Oppositely directed forces on this separating seam 16 will serve to separate the first portion from the second portion at the time such is needed and desired. FIG. 1 discloses the front surfaces of both the first portion 12 and the second portion 14.

The front surface of the first portion 12 is defined by indicia of a postal service return receipt which is even more specifically defined by current postal service form 3811. Such postal service return receipt includes among other compartments or areas an article number box as at 18. Other boxes as clearly indicated include a signature area for the addressee as at 20, date of delivery box as at 22, and proper address wherein the article in the form of the attached first class letter (second portion 14) is to be sent which is indicated as at 24. The other boxes are clearly indicated for purpose and design. It is noted that the receipt may be for either certified or registered mail.

The front surface of the second portion 14 defines the front face of a first class letter. This includes a personalized message zone generally indicated as 26 wherein sufficient space is provided to type, print, or write in a personalized message which is adapted to factual situation of the specific addressee to which the first class letter is to be sent. Preferably, this zone is highlighted to clearly indicate its importance. An address zone is generally indicated as 28 and such a zone is in the form of sufficient space to allow the name and address of the addressee to be printed or typed therein. Spaced from the address zone is a postal zone generally indicated as 30 wherein the correct amount of postage may be placed thereon in the form of a pre-printed postal meter indicator or proper stamps. In addition, an article number box generally indicated as 32 is spaced from the other zones as set forth above. Such article number box 32 provides sufficient space to insert the identifying article number, which is a series of numerals, wherein such article number corresponds to the article number placed within the article number zone or box 18 of the front surface of the first portion 12. A return address portion generally indicated as 34 is also formed on the front surface of the second portion so that in the event the letter cannot be properly delivered, the sender will be identified by terms of his address and name. The article number box is preferably at the top edge of the base sheet so that its color bleeds to the edge.

Another important feature of the present invention is the highlighting of both the personalized message zone 26 and the article number box 32. This highlighting can be in the form of a dye imprinted on the front surface wherein such dye is typically Pantone green or pink but it may be of any other applicable color.

With reference to FIG. 2, the rear surface of the mailer structure is seen. The first portion is indicated as 12 and the removably attached second portion is indicated at 14 as in FIG. 1. Further, the separating seam is consistently indicated at 16. The rear surfaces (FIG. 2) of both the first portion 12 and the second portion 14 are essentially pre-printed. More specifically, the rear surface of the first portion 12 includes a pre-printed address generally indicated as 36. This address constitutes the return address to which the postal service return receipt is to be sent. A pre-printed postal zone 38 indicates the amount of correct postage has been prepaid for the return domestic certified receipt.

The dimensional differences between the first portion 12 and the second portion 14 are different, preferably. The longitudinal dimension or width of the second portion is much greater than the longitudinal dimension of the first portion. The opposite side edges are of the same dimension for both the first portion and the second portions, that is they are substantially equal. By virtue of the changes in such dimensions of the first and second portions, the orientation or array of the address zone 36 and the postal zone 38 are substantially transverse or perpendicular to the orientation of a generalized message zone indicated as 40 formed on the rear surface of the second portion 14. The generalized message zone 40 will ordinarily be a pre-printed general message, for example, a notice required by a statute. It will be printed on all such second portions for the same type notice.

Figure 3:
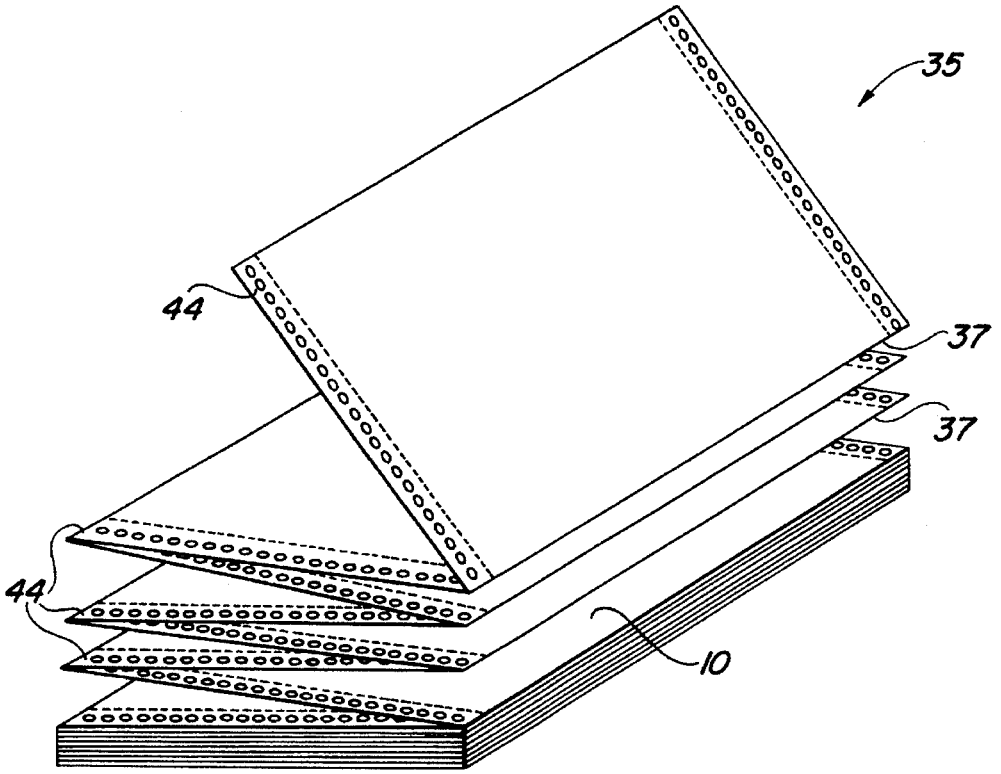
FIG. 3 is a partial perspective view of a plurality of the mailing structure in a fan folded condition for feeding into a typing machine or word processor with a pin drive.

Other features of the present invention include the existence two pin feed strips 42 and 44 attached to each of the opposite ends of the sheet as indicated in both FIGS. 1 and 2. This provides a way to feed a plurality of such base sheets from a fan folded stack 35, with the sheets in overlying relation to one another, which is a form most suitable for some types of automatic feed machines, see FIG. 3. Such sheets are a plurality of equally constructed or congruent sheets which are attached to one another along perforated lines, such as 37, defining and forming the longitudinal peripheral edges as at 44 and 46 extending along the entire length of both the first and second portion when such are connected to one another.

Figure 4:
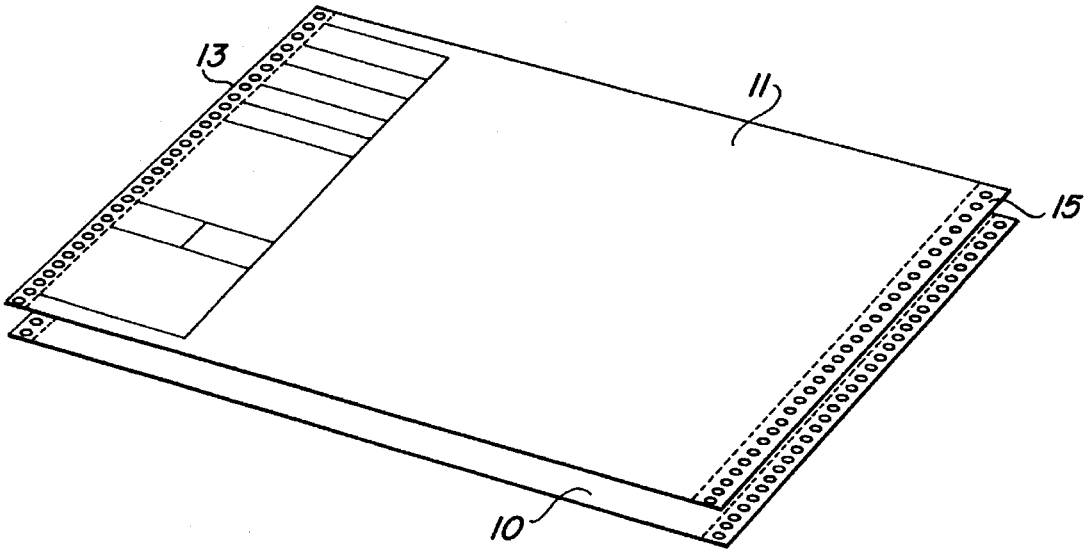
FIG. 4 is a mail structure composed of two sheets so that when the mail structure is typed, a receipt for the certified mail and copy of the message are simultaneously made.

Referring now to FIG. 4, most conveniently a congruent second sheet 11 may be included in the mailer structure. The second sheet may overlay as shown or underlay the base sheet. It is separable from the base sheet 10 but for purposes of processing, it is connected to the base sheet and include the pin drive strips 13 and 15. The sheets will be of the type that when typed upon a copy of what is typed will simultaneously appear on the underlying sheet.

Figure 5:
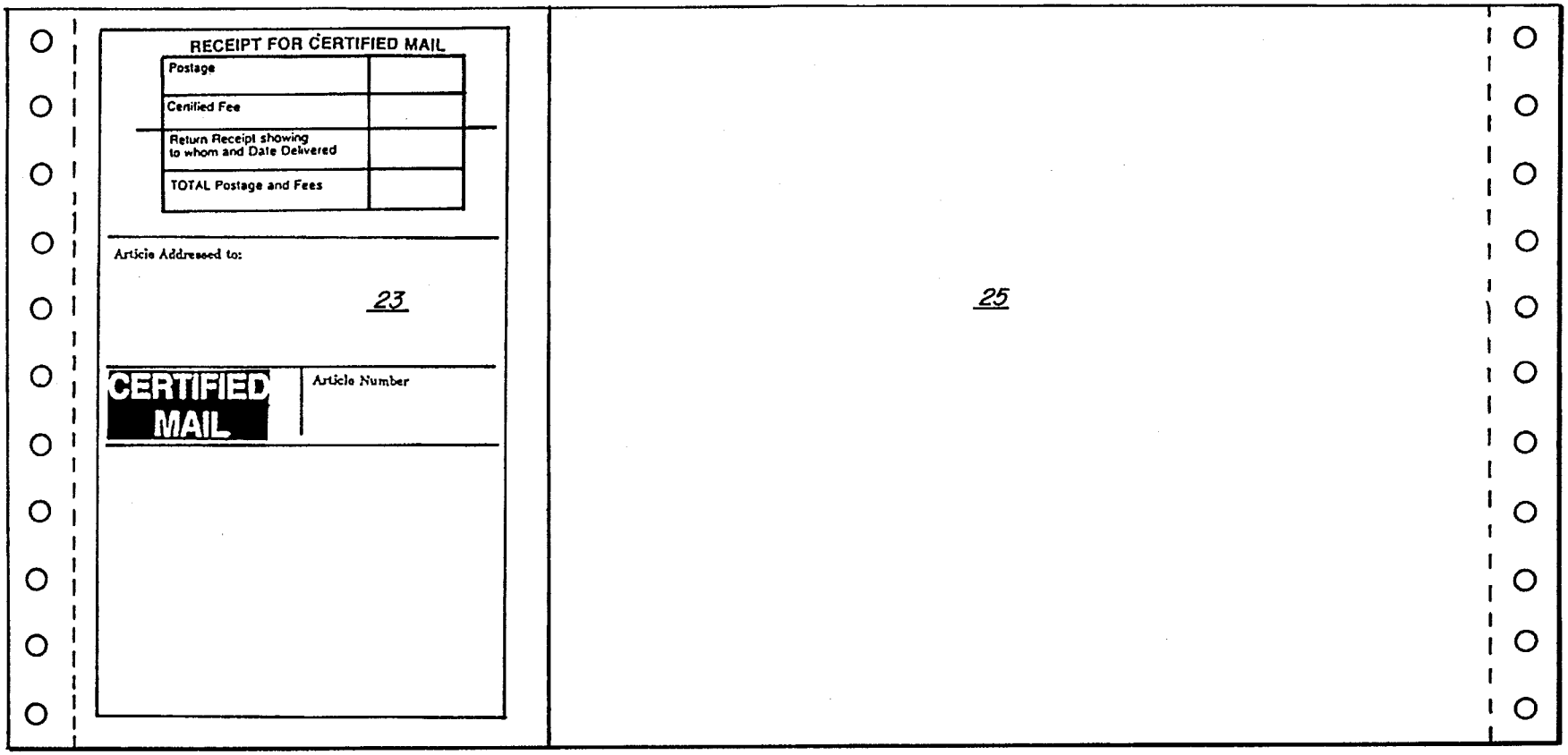
FIG. 5 is a view of a second sheet wherein the personalized message is made together with a Receipt for Certified Mail.

As seen in FIG. 5, the second sheet preferably includes a "Receipt for Certified Mail" zone 23 and a zone 25 where the personalized message, the name and address will be reproduced. On the reverse side, the general message 40 will be pre-printed preferably. Thus, when the sheets have been filled out and taken to the Post Office, the second sheets may be date-stamped by the postal clerk so that there is proof of the mailing and of what was mailed.

In a preferred embodiment, the mailer structure is rectangular of a) a thickness of between about 0.005" and about 0.015" and b) a height of about 5.5" and a longitudinal width in a range of between about 9" and about 10.5".

While this invention has been shown and described in what is considered to be a practical and preferred embodiment, it is recognized that departures can be made within the spirit and scope of this invention which should therefore not be limited except as set forth in the following claims and within the doctrine of equivalents.

Now that the invention has been described,

What is claimed is:

1. A base sheet comprising:

a) a first portion and a second portion each having a front surface and a rear surface, b) a separating seam means to segregate and removably connect said first and second portions to one another, c) said front surface of said first portion including a postal service return receipt zone formed thereon and said rear surface of said first portion including a preprinted return address indicia and a prepaid postage indicia formed thereon, d) said front surface of said second portion including a postal zone, an address zone spaced from said postal zone, a personalized message zone between said postal zone and said address zone, and an article number box zone formed thereon, said second portion having spaced top and bottom longitudinal extending edges, and e) said personalized message zone including a highlighted surface adapted to be visually distinguishable from a remainder of said front surface of said second portion, and said rear surface of said second portion including indicia defined by a pre-printed, generalized message.

2. A base sheet as in claim 1 wherein the seam means is of perforated construction.

3. A structure as in claim 2 further comprising a perforated pin feed strip removably secured to each of two opposite ends of said sheet and extending between opposite longitudinal edges of said sheet.

4. A structure as in claim 3 wherein said sheet is removably connected to a congruent sheet of equivalent construction along each of said longitudinal edges.

5. A structure as in claim 4 wherein said sheet and each of said congruent sheets are arranged in a fan folded stack orientation in overlying relation to one another.

6. A structure as in claim 1 wherein said postal service receipt zone comprises an article number box and an addressee signature space.

7. A structure as in claim 6 wherein said article number box on said first portion and said article number box zone on said second portion is cooperatively adapted to receive equivalent indicia indicative of article identification.

8. A structure as in claim 1 wherein said segregated line extends linearly between said oppositely disposed longitudinal edges of said sheet and is disposed transversely thereto.

9. A structure as in claim 8 wherein said first portion comprises a lesser longitudinal dimension and an equal transverse dimension relative to said second portion.

10. A structure as in claim 1 wherein said prepaid postal indicia and said pre-printed return address indicia on said rear surface of said first portion are oriented in an array substantially parallel to a transverse dimension of said sheet.

11. A structure as in claim 10 wherein said pre-printed generalized message on said rear surface of said second portion is disposed in an array oriented substantially parallel to a longitudinal dimension of said sheet and in substantially transverse relation to said indicia on said rear surface of said first portion.

12. In combination, a first class mail letter and a return receipt, said combination comprising:

a rectangular sheet having a front and rear surface, upper and lower opposite longitudinal edges and opposite right and left end edges and of a thickness in a range of between about 0.005" and about 0.015" of a height of about 5.5" and a longitudinal width in a range of between about 9" and about 10.5", a perforated line extending between the longitudinal edges of said sheet substantially 3.5" from a first opposite end edge of the front surface of said sheet, said perforated line separating the sheet into a first portion and a second portion, said first portion being adjacent said first opposite end edge of the front surface and said second portion being adjacent second opposite end edge, opposed to said first opposite end edge of said front surface, indicia on the first portion front surface comprising a postal service return receipt including an article number box and a space to be signed by the addressee of the combination, said second portion of said front surface having a postal zone on the front surface adjacent the juncture of the upper edge and right side edge of the front surface, an article number box indicia defining an article number box to receive a number corresponding to the article number box of said postal service return, said article being adjacent the upper edge on said front surface and being adjacent the postal zone and between the postal zone and the perforation line, an address zone adjacent a lower longitudinal edge, a return address zone adjacent the article number box and a personalized message zone between the article number box and the address zone, said rear surface of said first portion bearing indicia adjacent the lower longitudinal edge of said sheet at the juncture of said lower longitudinal edge and the perforation line with prepaid postal indicia and adjacent the first opposite end and extending between the upper and lower longitudinal edges, said rear surface of said second portion having indicia comprising, a generalized message arranged between the upper and lower longitudinal edges and said second opposite end and perforation line, said second portion having said front surface formed with a dye applied thereto in a Pantone color defining said article number box and said personalized message zone.

13. The combination as set forth in claim 12 wherein said sheet includes a perforated pin feed removable margin strip extending outwardly about one-half inches from both the first opposite end and the second opposite end and each connected to said sheet along a perforated line, each of said strips having a central row or equally spaced holes between the upper and lower longitudinal edges of about one-half inch spacing on center, said holes adjacent one of the opposite ends being about 3/16" and said holes being of about 1/8" in diameter.

14. The combination as set forth in claim 13 wherein said combination includes a second congruent sheet, said second congruent sheet overlying said sheet and said second congruent sheet including indicia comprising a postal service return receipt for certified mail, and an article addressee.

15. The combination as set forth in claim 12 including a plurality of said sheets interconnected in a continuous form by a perforated line and being fan-folded in overlying relation to one another.

16. The base sheet as set forth in claim 1 and a second congruent sheet comprising a "Receipt for Certified Mail" and copy reproducing means, said second sheet being congruent to said base sheet and removably connected thereto in overlaying relation thereof so that simultaneously upon typing on one of the sheets, the typed indicia is reproduced on the other sheet.

* * * * *